United States Patent [19]

Piazza, Jr.

[11] 4,202,559

[45] May 13, 1980

[54] SKATEBOARD

[76] Inventor: John Piazza, Jr., 53 Bertha Pl., Staten Island, N.Y. 10301

[21] Appl. No.: 932,428

[22] Filed: Aug. 10, 1978

[51] Int. Cl.[2] ..... B62B 11/00

[52] U.S. Cl. ..... 280/87.04 R; 280/11.27

[58] Field of Search ..... 280/87.01, 87.02 R, 280/87.03, 87.04 R, 87.04 A, 11.27; 185/37; 74/526; 267/150

[56] References Cited

U.S. PATENT DOCUMENTS

| | | | |
|---|---|---|---|
| 1,150,733 | 8/1915 | La Chall | 280/87.01 |
| 2,136,019 | 11/1938 | Pfau | 280/87.01 |
| 2,330,147 | 9/1943 | Rodriguez | 280/87.04 A |
| 3,069,182 | 12/1962 | Hufford | 280/87.01 |
| 3,117,771 | 1/1964 | Herr | 267/150 |
| 3,252,713 | 5/1966 | Heller | 280/87.01 |
| 3,442,528 | 5/1969 | Rademacher | 280/87.02 |
| 3,771,811 | 11/1973 | Bueno | 280/87.04 A |
| 3,995,873 | 12/1976 | Pantzer | 280/87.04 A |
| 4,054,297 | 10/1977 | Solimine | 280/87.04 A |

*Primary Examiner*—Joseph F. Peters, Jr.
*Assistant Examiner*—R. Schrecengost
*Attorney, Agent, or Firm*—James & Franklin

[57] ABSTRACT

In a skateboard comprising a rigid elongated board having front and rear portions, and front and rear wheel assemblies, the rear wheel assembly being fixedly mounted on the board rear portion, the improvement comprising a steering platform and a linkage system, secured to the front portion, connecting the platform above the board front portion and the front wheel assembly below the board front portion for pivotable movement as a unit relative to the board. Preferably the angle through which the platform/front wheel assembly unit is pivotable is limited and the platform/front wheel assembly unit is biased to a given orientation. The steering platform is spaced only slightly above the front portion and adapted to be pivoted by the forwardly disposed foot of the skateboard rider.

12 Claims, 3 Drawing Figures

SKATEBOARD

BACKGROUND OF THE INVENTION

The present invention relates to skateboards and more particularly to an improved skateboard which may be steered by the foot of the rider irrespective of any shifts in the distribution of the weight of the rider.

A conventional skateboard comprises a rigid elongated board having front and rear portions. A front wheel assembly is fixedly mounted below the board front portion and a rear wheel assembly is fixedly mounted beneath the board rear portion. Steering of the board is accomplished by a complex redistribution of the weight of the rider standing thereon. Learning to redistribute the weight as required to steer the skateboard in a swift and safe manner is a time-consuming and dangerous process which often discourages the novice skateboarder.

U.S. Pat. No. 3,771,811 describes an improved skateboard in which the rear wheel assembly is not fixedly mounted on the board rear portion (as in the conventional skateboard), but rather secured to a disc-like platform disposed above the rear portion of the board. The platform and the rear wheel assembly are pivotable as a unit when the platform is pivoted by the rearwardly disposed foot of the skateboard rider. As the steering of this improved skateboard does not require a redistribution of the weight of the user, the learning process is both simplified and rendered safer. Even this improved skateboard is, however, subjected to a number of deficiencies. The improved skateboard is steerable only through an angle of about 45°, thus depriving the rider thereof of the experience of the sharp turns which contribute greatly to the enjoyment of skateboard riding. Furthermore, the improved skateboard contains no mechanism for biasing the pivotable wheel assembly to its forwardly-facing position (that is, the position of the assembly which causes the skateboard to proceed in a direction aligned with its longitudinal axis) as is necessary when the board is being used in a jump. When a skateboard is used in a jump, it is essential that, upon its return to contact with the ground, both sets of wheel assemblies be forwardly-facing in order to prevent the novice rider from being spilled. Finally, the means for limiting the angle through which the rear wheel assembly may be pivoted is exposed on either side of the board where it is susceptible to being contacted and caught by an uneven riding surface or objects thereon (such as underbrush), again tending to spill the novice skateboarder.

Accordingly, it is an object of the present invention to provide a skateboard which is steerable by the foot of the rider without a redistribution of the rider's weight, while still providing the sharp turn capability characteristic of the conventional skateboard.

Another object is to provide such a skateboard containing means for biasing the pivotable wheel assembly to its forwardly-facing position so that the board may be safely used in jumps.

A further object is to provide such a skateboard in which the means for biasing the pivotable wheel assembly to its forwardly facing position is disposed within the board and not exposed.

Yet another object is to provide such a skateboard in which the means for limiting the angle through which the pivotable wheel assembly may be pivoted is disposed within the board and not exposed.

A final object is to provide such a skateboard which may be easily and safely ridden by even a novice skateboarder with only a minimum of practice.

SUMMARY OF THE INVENTION

It has now been found that the above and related objects are obtained in a skateboard comprising a rigid elongated board having front and rear portions, front and rear wheel assemblies, and means for fixedly mounting the rear wheel assembly below the rear portion. A steering platform is provided and means are secured to the board front portion to link the steering platform above the board front portion and the front wheel assembly below the board front portion for pivotal movement as a unit relative to the board. Preferably the board front portion defines an aperture extending vertically therethrough and the linking means extends through the aperture.

In a preferred embodiment the skateboard additionally includes means for limiting the angle through which the platform/front wheel assembly unit is pivotable and/or means for biasing the platform/front wheel assembly unit to a given orientation. Preferably the board front portion defines an aperture extending vertically therethrough and the linking means, the limiting means and the biasing means constitute a single unit substantially completely disposed within the aperture.

More particularly, the single unit comprises a bearing collar fixedly mounted in the board aperture and having an aperture extending through the sidewall thereof, a hollow bearing coaxially extending through the collar and having a transversely extending slot in the sidewall thereof, and a spiral spring coaxially disposed substantially within the bearing. The upper surface of the bearing and one end portion of the spring are operatively secured to the platform for pivotable movement therewith, while the bottom surface of the bearing is operatively secured to the front wheel assembly for pivotable movement therewith. The other end portion of the spring extends through the bearing slot and the collar aperture and is operatively secured to the board to preclude lateral movement of the end portion. Preferably, the bearing slot extends laterally between 145 and 180 degrees, this constituting the limit through which the platform/front wheel assembly unit may be pivoted.

In a preferred embodiment the bearing is longer than the collar and the collar aperture has a height greater than the difference in height between the bearing and the collar. Typically the steering platform is spaced only slightly above the board front portion and adapted to be pivoted by the forwardly disposed foot of the skateboard rider.

DETAILED DESCRIPTION OF THE PREFERRED EMBODIMENTS

Figure 1:
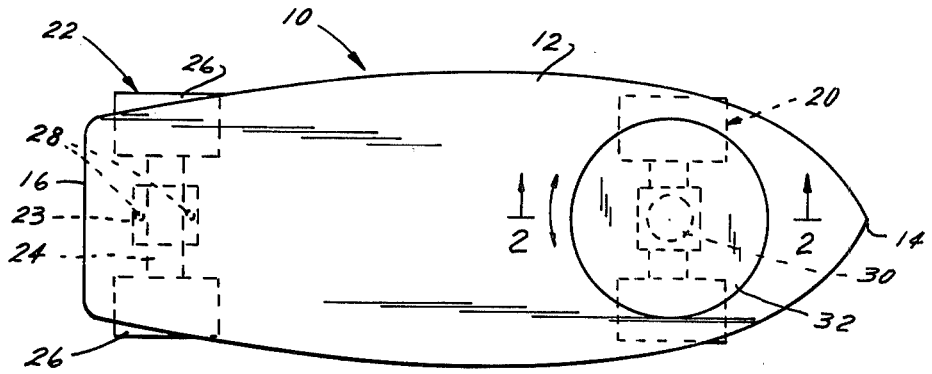
FIG. 1 is a top plan view of a skateboard according to the present invention.

Referring now to the drawing, and in particular to FIG. 1 thereof, therein illustrated is a skateboard generally designated 10 and embodying the principles of the present invention. As in a conventional skateboard, there is a rigid elongated board 12 having an inwardly tapering front portion 14 and a less severely tapered or flat rear portion 16. The skateboard 10 further includes a front wheel assembly generally designated 20 and a rear wheel assembly generally designated 22, each wheel assembly including a frame 23, a normally transverse axle 24 mounted in the frame 23, and wheels 26 affixed to opposite end portions of the axle 24 and adapted for rotation relative to the board 12. Conventional fastening means, such as screws 28, fixedly mount the upper portion of the rear wheel assembly 22 below the rear portion 16 of the board 12, the screws 28 maintaining the rear wheel assembly 22 in its forwardly-facing position and precluding the rear wheel assembly 22 from pivoting laterally relative to the board 12.

Unlike a conventional skateboard, however, the front portion 14 of the board 12 of the present invention defines a small circular aperture 30 extending vertically therethrough. A steering platform 32 is disposed above the board front portion 14, the top thereof preferably being provided with a non-slip surface (for example, by embossing) to enhance the frictional contact between the rider's foot and the upper surface of the platform 32. The upper surface of the steering platform 32 may be flat (as shown) or convexly beveled. The periphery of the circular steering platform 32 is preferably, but not necessarily, contained within the periphery of the board 12. Preferably the steering platform 32 is only slightly spaced above the board front portion 14 so that it may be easily pivoted by the forwardly disposed foot of the skateboard rider.

Figure 2:
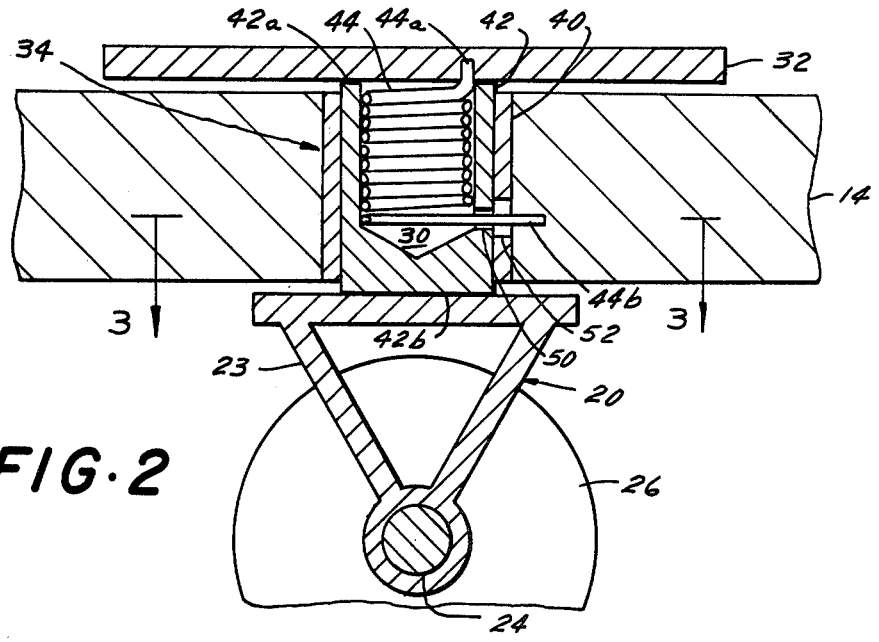
FIG. 2 is a fragmentary sectional view taken along the line 2—2 of FIG. 1.
Figure 3:
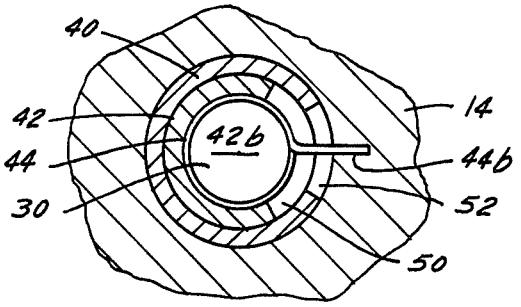
FIG. 3 is a fragmentary sectional view taken along the line 3—3 of FIG. 2.

Referring now in particular to FIGS. 2–3, generally speaking, the skateboard 10 according to the present invention further includes linking or connecting means 34 secured to the board front portion 14 and extending vertically through the board front portion aperture 30. The linking means 34 links the platform 32 above the board front portion 14 and the front wheel assembly 20 below the board front portion 14 for pivotable movement as a unit relative to the board 12.

More particularly, there is provided a bearing collar 40 fixedly (i.e., non-pivotably) mounted in said board front portion aperture 30, a hollow bearing 42 coaxially extending through said collar 40, and a spiral spring 44 coaxially disposed substantially within the hollow of the bearing 42. The bearing 42 is open at the top, closed at the bottom, and preferably longer than the bearing collar 40. The upper surface 42*a* of the bearing and the upper end portion 44*a* of the spring are operatively secured to the bottom of the steering platform 32 for pivotal movement therewith (for example by conventional adhesives and/or fasteners), while the bottom surface 42*b* of the bearing is operatively secured to the top of the frame 23 of the front wheel assembly 20 for pivotal movement therewith (for example, by conventional adhesives and/or fasteners). Thus the bearing 42 connects the platform 32 above the board front portion 14 and the front wheel assembly 20 below the board front portion 14 for pivotable movement as a unit relative to the board 12, the bearing 42 being pivotable within limits (as explained hereinafter) relative to the collar 40. The bearing 42 includes a transversely extending slot 50 in the sidewall thereof, and the bearing collar 40 has an aperture 52 extending through the sidewall thereof. The bearing slot 50 preferably extends transversely between 145 and 180 degrees, this in turn (as will be evident hereinafter) constituting the upper limit of the angle through which the platform/front wheel assembly unit is pivotable. The lower end portion 44*b* of the spring extends successively through the bearing slot 50 and the collar aperture 52 and is operative secured to the board 12 to preclude lateral movement thereof (for example, by conventional adhesives and/or fasteners).

As the spring end portion 44*b* is fixed relative to the board 12 and passes through the slot 50 of the bearing 42, it limits the degree to which the bearing 42 may be turned within the collar 40 (before one side or the other of the bearing slot 50 abuts against the spring end portion 44*b*) and thus limits the angle through which the platform/front wheel assembly unit secured to the bearing 42 is pivotable. It will also be apparent that as the turning of the steering platform 32 from its normal or unstressed orientation draws with it the upper spring end portion 44*a* operatively secured thereto, it creates stresses within the spring 44 (as the lower spring end portion 44*b* is fixedly secured to the board 12 against lateral movement). Thus when the skateboard rider removes his foot from the steering platform 32, the stressed spring 44 will tend to return the steering platform 32 to its normal unstressed orientation. As the steering platform 32 is connected to the front wheel assembly 20 (by the bearing 42), this will in turn cause the front wheel assembly 20 to return to its normal forward-facing orientation, assuming that the skateboard 10 is in a leap so that there is no frictional contact between the front wheel assembly 20 and the ground to resist the biasing action of the spring 44. Thus the spring 44 serves to bias the platform/front wheel assembly unit to a given orientation, generally the forward-facing orientation of the front wheel assembly 20.

It will be appreciated that the bearing 42 is rotatable relative to both the collar 40 and the spring 44 within the constraints imposed by the lower spring end portion 44*b*. It will further be appreciated that in principle the collar aperture 52 need not transversely extend as far as the bearing slot 50 (as illustrated), but is shown as having a transverse extent greater than the width of the lower spring end portion 44*b* only because the same facilitates insertion of the lower spring end portion 44*b* therethrough.

In order to reduce the shearing forces acting upon the spring end portion 44*b*, the height of the bearing collar aperture 52 is preferably greater (by at least the height of the spring end portion 44*b*) than the difference in height between the bearing 42 and its collar 40. Thus when the skateboard rider's weight is on the board front portion 14, but not on the steering platform 32, the bearing 42 can move upwardly relative to its collar 40 until the board front portion 14 is directly supported on the front wheel assembly 20 at least partially by the bearing collar 40 (and not only by the bearing 42 and the abutment of spring end portion 44*b* against the top of collar aperture 52 and the bottom of bearing slot 50).

In one method of manufacture of the skateboard, the spring 44 is first placed within the bearing 42 with the lower spring end portion 44*b* extending through the bearing slot 50, and then the bearing/spring subassembly is mounted in the collar 40 with the lower spring end portion 44*b* extending through the collar aperture 52. The spring/bearing/collar assembly is then inserted into the board aperture 30, the collar 40 secured to the board 12, and finally the steering platform 32 and front wheel assembly 20 appropriately secured to the assembly.

When the skateboard rider wishes to turn the skateboard he has merely to place his front foot upon the steering platform 32 and pivot the same in the direction of the desired turn. The abutment of the lower spring end portion 44*b* against the ends of the bearing slot 50 determines the extent to which the platform/front wheel assembly unit may be turned. When the skateboard rider jumps the skateboard, he has only to remove his foot from the steering platform 32 at which point (as soon as the front wheel assembly 20 is off the ground) the spring 44 will, if necessary, return the front wheel assembly 20 to its forwardly-facing orientation to permit a safe landing.

As the linking means, limiting means and biasing means constitute a single unit substantially completely disposed within the front board portion 14 (except for the end portions of the bearing 42 extending slightly thereabove and therebelow and the spring end portion 44*a* extending slightly thereabove), the skateboard can be riden even through underbrush without danger of these functional structural elements becoming caught thereon. As the skateboard of the present invention may be used to make sharp turns and safe jumps, the rider can easily experience all of the thrills associated with conventional skateboarding in safety and without the many hours of practice normally required.

Now that the preferred embodiments of the present invention have been shown and described in detail, various modifications and improvements thereon will become readily apparent to those skilled in the art. For example, the steering platform may include an upstanding steering post of suitable height, thereby to enable the platform/front wheel assembly unit to be turned manually without the use of the skateboard rider's foot. Accordingly, the spirit and scope of the present invention is to be limited only by the appended claims, and not by the foregoing disclosure.

I claim:

1. A skateboard comprising:

(A) a rigid elongated board having front and rear portions;

(B) first and second wheel assemblies;

(C) means for fixedly mounting said second wheel assembly below said second portion;

(D) a steering platform;

(E) means, secured to said first portion, linking said platform above said first portion and said first wheel assembly below said first portion for pivotal movement as a unit relative to said board;

(F) means for limiting the angle through which said platform/first wheel assembly unit is pivotable; and (G) means for biasing said platform/first wheel assembly unit to a given orientation;

said first portion defining an aperture extending vertically therethrough, and said linking means, said limiting means, and said biasing means constituting a single unit substantially completely disposed within said aperture, said single unit comprising a bearing collar fixedly mounted in said aperture and having an aperture extending through the sidewall thereof, a hollow bearing coaxially extending through said collar and having a transversely extending slot in the sidewall thereof, and a spiral spring coaxially disposed substantially within said bearing, the upper surface of said bearing and one end portion of said spring being operatively secured to said platform for pivotal movement therewith, the bottom surface of said bearing being operatively secured to said first wheel assembly for pivotal movement therewith, and the other end portion of said spring extending through said bearing slot and said collar aperture and being operatively secured to said board to preclude lateral movement thereof.

2. The skateboard of claim 1 wherein said bearing is longer than said collar.

3. The skateboard of claim 2 wherein said collar aperture has a height greater than the difference in height between said bearing and said collar.

4. The skateboard of claim 1 wherein said bearing slot extends laterally between 145 and 180 degrees.

5. The skateboard of claims 1, 2, or 3 wherein said first and second wheel assemblies are respectively front and rear wheel assemblies, said first and second board portions are respectively front and rear board portions, and said steering platform is spaced only slightly above said front portion and adapted to be pivoted by the forwardly disposed foot of the skateboard rider.

6. A skateboard comprising:

(A) a rigid elongated board having first and second portions;

(B) first and second wheel assemblies;

(C) means for fixedly mounting said second wheel assembly below said second board portion;

(D) a steering platform;

(E) means, secured to said first board portion, linking said platform above said first board portion and said first wheel assembly below said first board portion for pivotal movement as a unit relative to said board; and (F) means for limiting the angle through which said platform/first wheel assembly unit is pivotable;

said first board portion defining an aperture extending vertically therethrough, and said linking means and said limiting means constituting a single unit substantially completely disposed within said aperture, said single unit comprising a bearing collar fixedly mounted in said aperture, a bearing coaxially extending through said collar and having a transversely extending slot in the sidewall thereof, the upper surface of said bearing being operatively secured to said platform for pivotal movement therewith, the bottom surface of said bearing being operatively secured to said first wheel assembly for pivotal movement therewith, and a limit member operatively secured to said board to preclude lateral movement thereof and extending into said bearing slot to limit pivotal movement of said bearing relative to said board.

7. The skateboard of claim 6 wherein said first and second wheel assemblies are respectively front and rear wheel assemblies, and said first and second board portions are respectively front and rear board portions.

8. A skateboard comprising:

(A) a rigid elongated board having first and second portions;

(B) first and second wheel assemblies;

(C) means for fixedly mounting said second wheel assembly below said second board portion;

(D) a steering platform;

(E) means, secured to said first board portion, linking said platform above said first board portion and said first wheel assembly below said first board portion for pivotal movement as a unit relative to said board; and (F) means for biasing said platform/first wheel assembly unit to a given orientation;

said first board portion defining an aperture extending vertically therethrough, and said linking means and said biasing means constituting a single unit substantially completely disposed within said aperture, said single unit comprising a bearing collar fixedly mounted in said aperture and having an aperture extending through the sidewall thereof, a hollow bearing coaxially extending through said collar and having an aperture in the sidewall thereof, and a spiral spring coaxially disposed substantially within said bearing, the upper surface of said bearing and one end portion of said spring being operatively secured to said platform for pivotal movement therewith, the bottom surface of said bearing being operatively secured to said first wheel assembly for pivotal movement therewith, and the other end portion of said spring extending through said bearing aperture and said collar aperture and being operatively secured to said board to preclude lateral movement thereof.

9. The skateboard of claim 8 wherein said first and second wheel assemblies are respectively front and rear wheel assemblies, and said first and second board portions are respectively front and rear board portions.

10. Apparatus for use in a skateboard comprising a rigid elongated board having first and second portions, said first portion defining an aperture extending vertically therethrough; first and second wheel assemblies; and means for fixedly mounting said second wheel assembly below said second portion; said apparatus comprising:

(A) steering means;

(B) means, adapted to be secured to said first portion, said steering means and said first wheel assembly, for linking said steering means above said first portion and said first wheel assembly below said first portion for pivotal movement as a unit relative to said board;

(C) means for limiting the angle through which said steering means/first wheel assembly unit is pivotable, and (D) means for biasing said steering means/first wheel assembly unit to a given orientation;

said linking means, said limiting means, and said biasing means constituting a unit configured and dimensioned to be substantially completely disposed within said aperture, said unit when so disposed comprising a bearing collar fixedly mounted in said aperture and having an aperture extending through the sidewall thereof, a hollow bearing coaxially extending through said collar and having a transversely extending slot in the sidewall thereof, and a spiral spring coaxially disposed substantially within said bearing, the upper surface of said bearing and one end portion of said spring being operatively secured to said steering means for pivotal movement therewith, the bottom surface of said bearing being operatively secured to said first wheel assembly for pivotal movement therewith, and the other end portion of said spring extending through said bearing slot and said collar aperture and being operatively secured to said board to preclude lateral movement thereof.

11. Apparatus for use in a skateboard comprising a rigid elongated board having first and second portions, said first portion defining an aperture extending vertically therethrough, first and second wheel assemblies; and means for fixedly mounting said second wheel assembly below said second portion; said apparatus comprising:

(A) steering means;

(B) means, adapted to be secured to said first portion, said steering means and said first wheel assembly, for linking said steering means above said first portion and said first wheel assembly below said first portion for pivotal movement as a unit relative to said board; and (C) means for limiting the angle through which said steering means/first wheel assembly unit is pivotable;

said linking means and said limiting means constituting a unit configured and dimensioned to be substantially completely disposed within said aperture, said unit when so disposed comprising a bearing collar fixedly mounted in said aperture, a bearing coaxially extending through said collar and having a transversely extending slot in the sidewall thereof, the upper surface of said bearing being operatively secured to said steering means for pivotal movement therewith, the bottom surface of said bearing being operatively secured to said first wheel assembly for pivotal movement therewith, and a limit member operatively secured to said board to preclude lateral movement thereof and extending into said bearing slot to limit pivotal movement of said bearing relative to said board.

12. Apparatus for use in a skateboard comprising a rigid elongated board having first and second portions, said first portion defining an aperture extending vertically therethrough first and second wheel assemblies; and means for fixedly mounting said second wheel assembly below said second portion; said apparatus comprising:

(A) steering means;

(B) means, adapted to be secured to said first portion, said steering means and said first wheel assembly, for linking said steering means above said first portion and said first wheel assembly below said first portion for pivotal movement as a unit relative to said board; and (C) means for biasing said steering means/first wheel assembly unit to a given orientation;

said linking means and said biasing means constituting a unit configured and dimensioned to be substantially completely disposed within said aperture, said unit when so disposed comprising a bearing collar fixedly mounted in said aperture and having an aperture extending through the sidewall thereof, a hollow bearing coaxially extending through said collar and having an aperture in the sidewall thereof, and a spiral spring coaxially disposed substantially within said bearing, the upper surface of said bearing and one end portion of said spring being operatively secured to said steering means for pivotal movement therewith, the bottom surface of said bearing being operatively secured to said first wheel assembly for pivotal movement therewith, and the other end portion of said spring extending through said bearing aperture and said collar aperture and being operatively secured to said board to preclude lateral movement thereof.

* * * * *